US010631581B2

(12) United States Patent
Zatkovich

(10) Patent No.: US 10,631,581 B2
(45) Date of Patent: Apr. 28, 2020

(54) BRA HAVING ARM SUPPORT

(71) Applicant: Margo Marie Zatkovich, Santa Rosa, CA (US)

(72) Inventor: Margo Marie Zatkovich, Santa Rosa, CA (US)

( * ) Notice: Subject to any disclaimer, the term of this patent is extended or adjusted under 35 U.S.C. 154(b) by 307 days.

(21) Appl. No.: 15/717,766

(22) Filed: Sep. 27, 2017

(65) Prior Publication Data

US 2018/0014580 A1 Jan. 18, 2018

Related U.S. Application Data

(63) Continuation-in-part of application No. 15/132,594, filed on Apr. 19, 2016, now abandoned.

(60) Provisional application No. 62/178,812, filed on Apr. 21, 2015.

(51) Int. Cl.

| | |
|---|---|
| ***A41C 3/08*** | (2006.01) |
| ***A41D 27/10*** | (2006.01) |
| *A41C 3/00* | (2006.01) |

(52) U.S. Cl.

CPC ..... *A41C 3/08* (2013.01); *A41D 27/10* (2013.01); *A41B 2400/38* (2013.01); *A41C 3/005* (2013.01); *A41D 2400/26* (2013.01); *A41D 2400/38* (2013.01)

(58) Field of Classification Search

CPC .. A41C 3/08; A41C 5/00; A41D 27/00; A41D 1/65; A41B 9/06; A41B 11/14

USPC ..... 2/69, 113, 54, 59, 109; 450/30

See application file for complete search history.

(56) References Cited

U.S. PATENT DOCUMENTS

| | | | | |
|---|---|---|---|---|
| 2,675,556 | A * | 4/1954 | Collier | A41D 1/04 2/108 |
| 3,421,514 | A * | 1/1969 | Friedlander | A41D 27/136 450/30 |
| 4,016,027 | A * | 4/1977 | Kintanar | A41D 19/00 2/159 |
| 4,570,267 | A * | 2/1986 | Appel | A41B 9/06 2/91 |
| 4,625,338 | A * | 12/1986 | Starling | A41B 9/06 2/106 |
| 6,183,339 | B1 * | 2/2001 | Thompson | A41B 9/06 2/55 |
| 6,393,611 | B1 * | 5/2002 | Thompson | A41B 9/06 2/55 |
| 7,429,206 | B2 * | 9/2008 | Perry | A41B 9/06 2/109 |
| 8,650,662 | B2 * | 2/2014 | Decker | A41D 27/10 2/16 |
| 9,027,164 | B2 * | 5/2015 | Seiler | A41D 1/22 2/16 |

(Continued)

OTHER PUBLICATIONS

Merriam-Webster, Definition of "sheer," << https://www.merriam-webster.com/dictionary/sheer >>, printed Dec. 7, 2019.

(Continued)

*Primary Examiner* — Gloria M Hale
(74) *Attorney, Agent, or Firm* — Dergosits & Noah LLP

(57) ABSTRACT

An undergarment such as a bra has very sheer sleeves such that the sleeves are virtually invisible. The sheer sleeves are also elasticized, for example, made of nylon and spandex, to provide compressive support to the wearer's arms. The sheer sleeves may have a color that matches one of several different skin tones.

20 Claims, 4 Drawing Sheets

(56) References Cited

U.S. PATENT DOCUMENTS

| | | | | |
|---|---|---|---|---|
| 2006/0089081 | A1* | 4/2006 | Peay | A41C 3/08 450/1 |
| 2007/0163026 | A1* | 7/2007 | Perry | A41B 9/06 2/69 |
| 2010/0005560 | A1* | 1/2010 | Albizre | A41B 11/14 2/54 |
| 2010/0033809 | A1* | 2/2010 | Hueber | A41D 31/00 359/361 |
| 2012/0047624 | A1* | 3/2012 | Hubsmith | A41D 15/00 2/125 |
| 2013/0185845 | A1* | 7/2013 | Decker | A41D 27/10 2/243.1 |

OTHER PUBLICATIONS

Dictionary.com, Definition of "sheer," << https://www.dictionary.com/browse/sheer >>, printed Dec. 7, 2019.

Cambridge University Press, Definition of "sheer," << https://dictionary.cambridge.org/us/dictionary/english/sheer >>, printed Dec. 7, 2019.

Wikipedia, excerpt from "Units of Textile Measurement," << https://en.wikipedia.org/wiki/Units_of_textile_measurement#Denier >>; printed Dec. 7, 2019.

Wikipedia, "Sheer Fabric," << https://en.wikipedia.org/wiki/Sheer_fabric >>; printed Dec. 7, 2019.

UK Tights, "How Tights Denier ," << http://www.uktights.com/page/denier >>; captured on Internet Archive Wayback Wachine Mar. 18, 2015.

Wolford AG, excerpt from "How Tights Denier Work (pictures omitted)," << https://www.wolfordshop.com/how-tights-denier-work.html >>; printed Dec. 7, 2019.

* cited by examiner

BRA HAVING ARM SUPPORT

CROSS REFERENCE

This application claims priority from U.S. Provisional Patent Application No. 62/178,812, filed Apr. 21, 2015, entitled My New Arms, and U.S. patent application Ser. No. 15/132,594, filed Apr. 19, 2016, entitled Triceps Support Garment, both of which are incorporated by reference herein in their entirety.

TECHNICAL FIELD

This disclosure relates to clothing, and more particularly, to a garment such as a brassiere having a very sheer, integrated sleeve that both supports and hides sagging, flabby arms and triceps muscles.

BACKGROUND

There are more than 75 million "baby boomers" in the United States over the age of 55, and half of those are women. Further, many of these women suffer from unsightly flabby and sagging arms due to effects of aging skin, or due to medical issues such as burns or bruising, or from atrophy, which often occurs in breast cancer survivors.

The triceps are the large muscles located on the back of the upper arm, and these muscles tend to lose tone and definition over time since the triceps are not regularly worked in routine day-to-day activities. Also, a significant loss of weight without corresponding exercise can lead to saggy triceps.

Women tend to avoid wearing clothing that reveals their unsightly arms and triceps muscles, such as sleeveless tops and sun dresses, because they do not like the way their arms look in such clothing. While exercise and a sound diet can often address some of these issues, many women do not make that effort. Thus, it would be desirable if there were a way to support and/or hide their arms and triceps muscles even in sleeveless clothing.

DETAILED DESCRIPTION

This disclosure describes a garment, preferably a bra, configured to have long sleeves attached to arm openings. The sleeves are made from a thin, sheer or ultrasheer fabric, such as nylon/spandex, so that the sleeves are virtually invisible to the eye, but the elasticity of the fabric also provides support and compression such that saggy and flabby underarms are held firm and tight by the fabric. The sleeves can be made in a variety of skin tone shades to provide a virtually invisible set of sheer sleeves for different skin colors.

Figure 1:
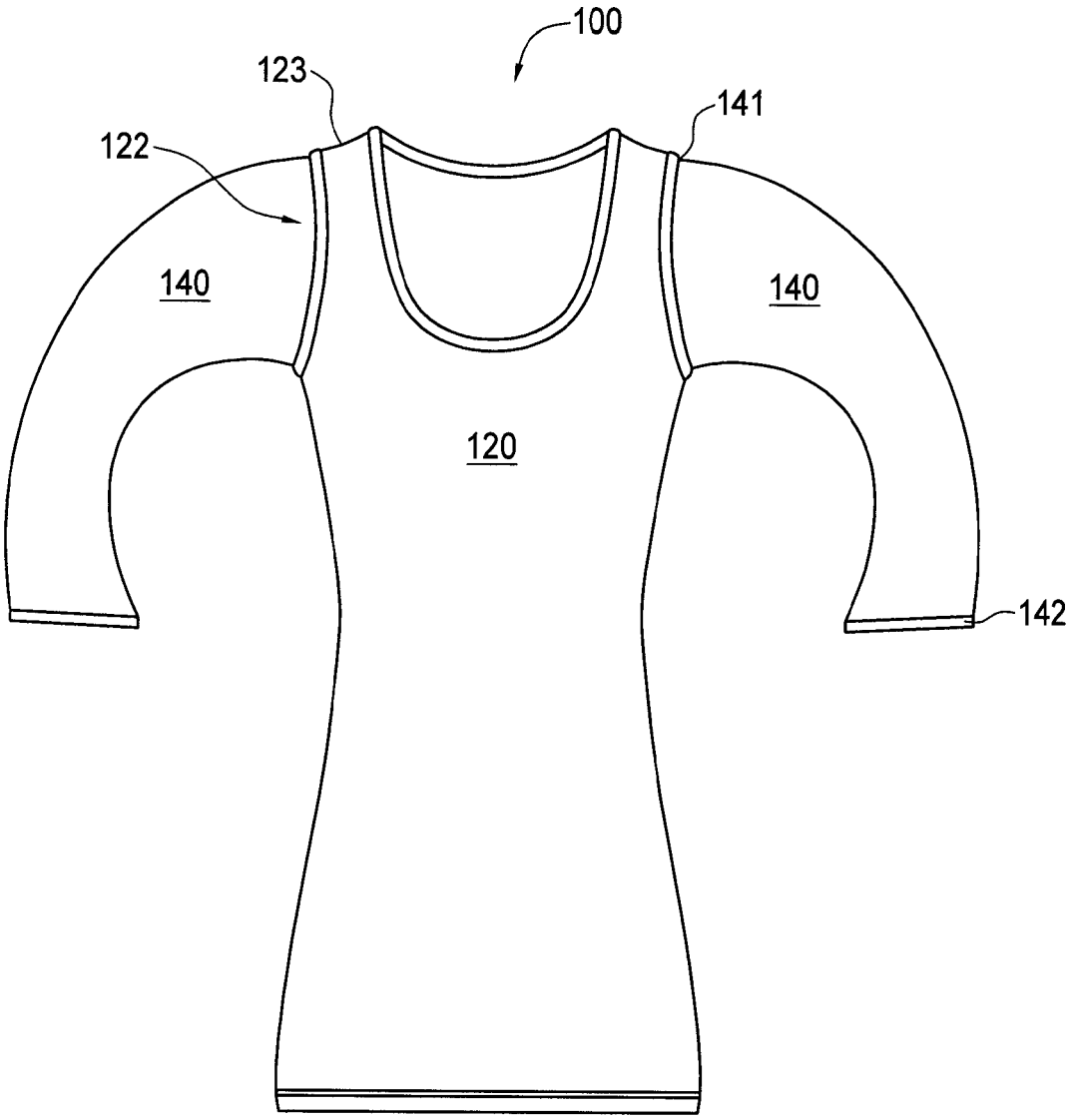
FIG. 1 is a front plan view of a sleeveless garment having sheer support sleeves attached to the garment.

FIG. 1 illustrates a first embodiment of a garment 100 designed to provide aesthetic covering of unsightly arms as well as functional support for arms and triceps. The garment 100 includes a torso portion 120 having a pair of arm openings 122 for the wearer's left and right arms, where the arm openings are defined by shoulder straps 123 on each side of the garment that extend from the front of the torso portion, over the shoulder, to the rear of the torso portion. A pair of sheer sleeve portions 140 are affixed to the arm openings 122 of the torso portion 120, for example, by sewing a seam 141, preferably on the inside of the garment, where each sleeve portion is sewn to a respective shoulder strap 123 at each arm opening, for example, by a double stitch. Domestic and industrial sewing methods are well-known and need not be discussed herein in any detail.

The torso portion 120 can be any sleeveless garment, such as a tank top, sleeveless dress, or vest, for example. The torso portion 120 may be made of a cotton fabric, a synthetic fabric, a blend of cotton and one or more synthetic fabrics, or any other suitable fabric.

The sleeve portions 140 are made from one or more very sheer synthetic fabrics, wherein at least one of the synthetic fabrics has significant elasticity, such as nylon or spandex. In one example, the sleeve portions 140 are long sleeves made from a combination of nylon and spandex, similar to most pantyhose. In one specific embodiment, the sleeve portions 140 are constructed from a sheer, run-resistant fabric that is 85% nylon and 15% spandex with a linear density of 15 deniers or less, and providing a sun protection factor ("SPF") against ultraviolet radiation of at least 15 SPF, and preferably 50 SPF. For example, the sleeve fabric can be made using a Jacquard circular knitting machine or other equivalent techniques. In general, it is known that a hosiery fabric having a linear density of less than about 30 denier is considered sheer, while a hosiery fabric having a linear density of less than about 10 denier is considered ultrasheer.

The sleeve portions 140 are made to be very sheer, that is, having a very thin or transparent texture, such that the sleeves are virtually invisible to the naked eye. Further, the synthetic fabrics that make up the sleeve portions 140 can be manufactured with a color to resemble a skin tone, for example using a continuous dye process. The sleeves could be dyed using well-known commercial dyeing techniques to have a number of different color shades, such as pale, tan, bronze, cocoa and black.

By providing elasticized nylon/spandex sleeve portions 140, the wearer of the garment 100 will have support for sagging or flabby arms and triceps muscles. Further, by providing a very sheer fabric with skin tone colored sleeves, the sleeves will appear natural and will hide blemishes, bruising, burns, or any unsightly skin condition of the arms.

The sleeve portions 140 can also include a wrist band portion 142 having an elastic finish so that the sleeve stays put along the entire arm of the wearer. For example, the wrist band 142 can be finished with an elastic band made of 80% polyester and 20% rubber and having a width of approximately 1/16 to 1/8 inch. The wrist band 142 is thus not very prominent and is able to be covered with a watch or bracelet so as to not be seen at all. Domestic and industrial techniques for finishing the sleeve portions 140 are well-known.

Figure 2A:
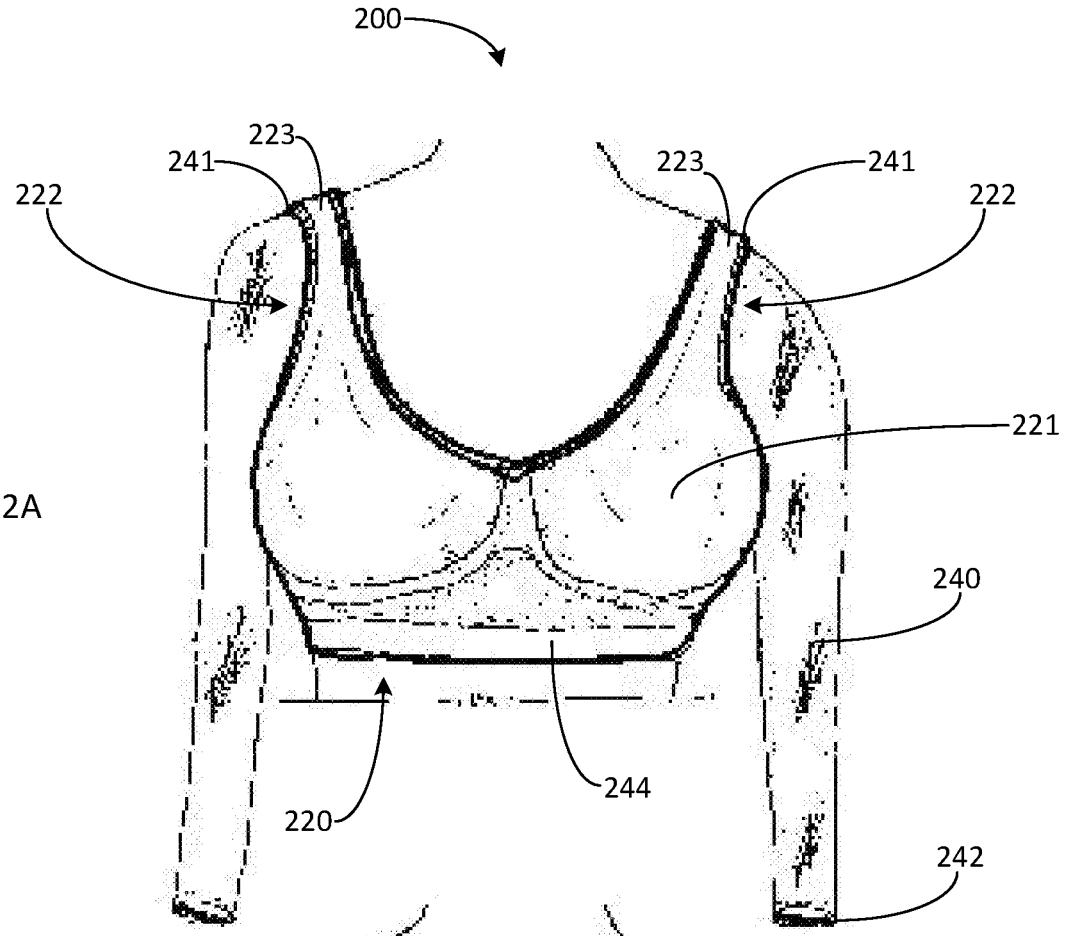
FIG. 2A is a front perspective view of a first embodiment of a bra having sheer support sleeves attached to the bra.
Figure 2B:
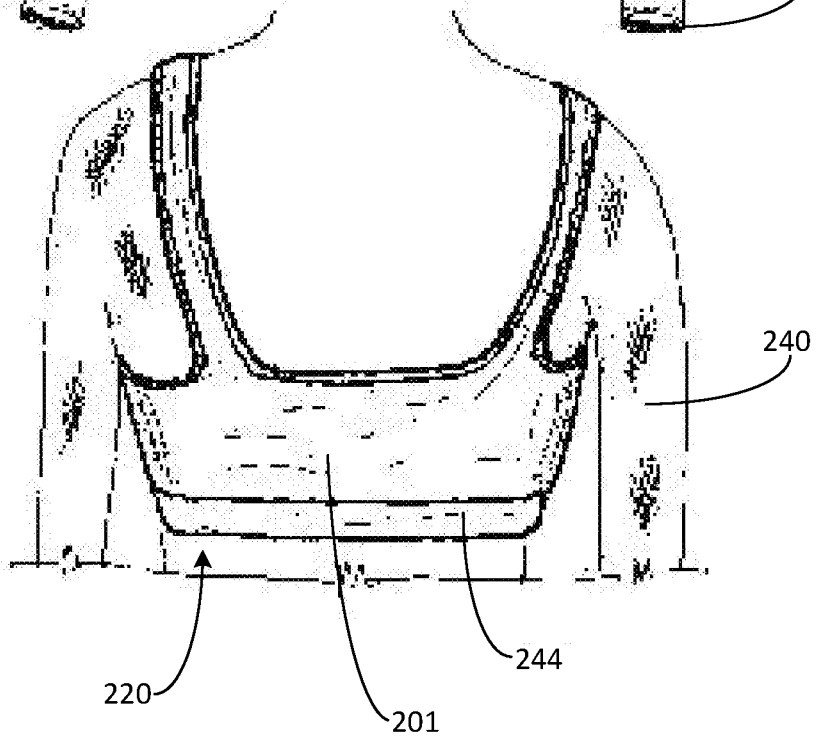
FIG. 2B is a rear perspective view of the bra shown in FIG. 2A.

FIGS. 2A and 2B illustrate a second embodiment of a garment 200 designed to provide aesthetic covering of unsightly arms as well as functional support of arms and triceps in an outer under garment. In this embodiment, the torso portion 220 is implemented as a bra having double stitched bra straps 223 that define arm openings 222. The bra 200 will typically include a pair of breast cups 221 having a concave shape.

Of course, bras come in many shapes and sizes to accommodate women and breasts of different sizes, but in general have in common the features of the bra 200 shown in FIGS. 2A and 2B. In one embodiment, the bra 200 is formed of an elasticized fabric, such as nylon and spandex, or other suitable materials. In one specific embodiment, the bra 200 is made of 90-96% nylon and 4-10% spandex. For example, Hanes makes a variety of sports bras that are suitable for this application.

The sleeve portions 240 are the same as described above with reference to FIG. 1, that is, they made from one or more synthetic fabrics, wherein at least one of the synthetic fabrics has significant elasticity, such as spandex. In one embodiment, the sleeve portions 240 are made of 85% nylon and 15% spandex. As in FIG. 1, the sleeve portions 240 are sheer or ultrasheer, run-resistant, and can be made to have a skin tone color such that the sleeves are virtually invisible. Further, an elasticized wrist band portion 242 as described with reference to FIG. 1 can be provided so that the sleeve stays put along the entire arm of the wearer. The sleeve portion 240 is sewn to the arm openings 222 of the bra 220 at seam 241 using known methods, preferably on the inside of the straps 223.

The bra 200 may also include an elasticized support band 244 below the breast cups 221 to help hold the bra in place on the user. For example, the support band 244 can be an elastic band made of 80% polyester and 20% rubber, with a width of approximately 1 and ½ inch.

The back portion 201 of the bra 200 may be cut low so that the bra is suitable for use with evening wear, for example.

Figure 3A:
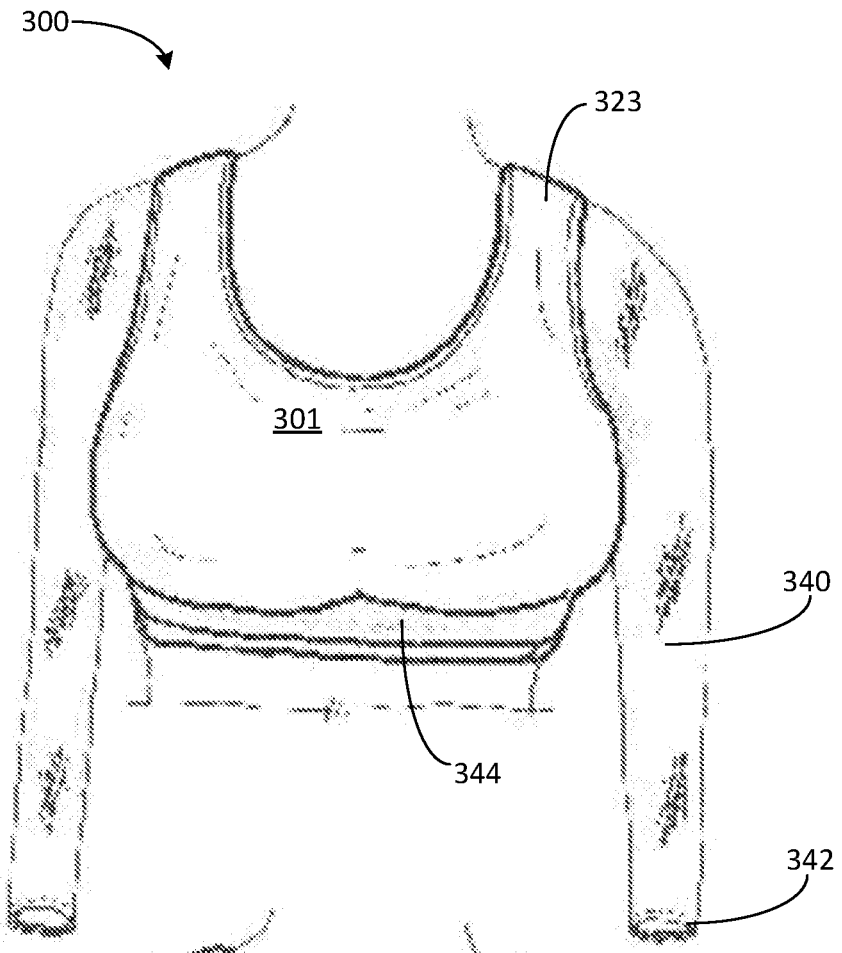
FIG. 3A is a front perspective view of a second embodiment of a bra with racer back styling having sheer support sleeves attached to the bra.
Figure 3B:
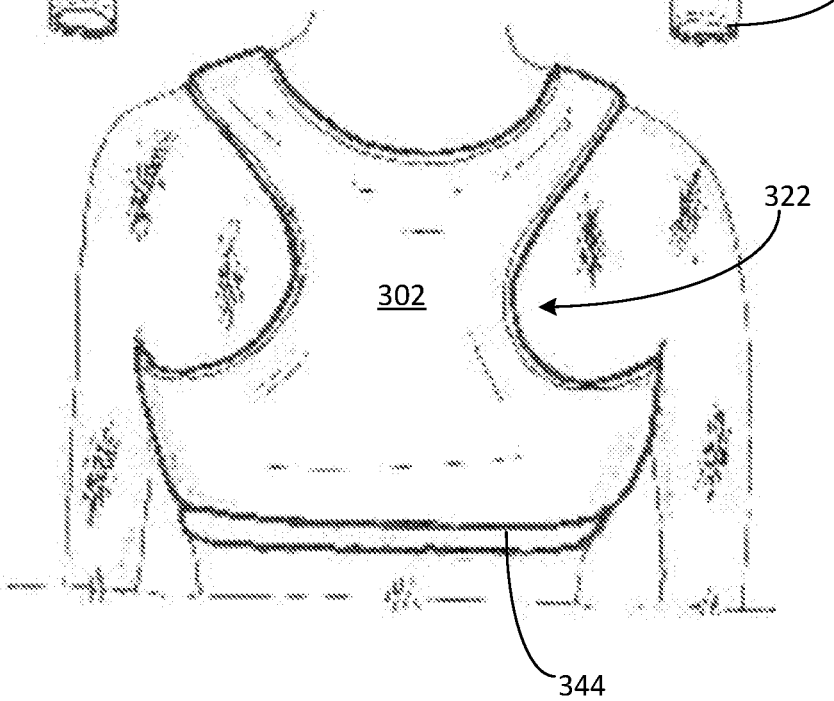
FIG. 3B is a rear perspective view of the bra shown in FIG. 3A.

FIGS. 3A and 3B illustrate an alternative bra 300 having a "racer back" sport style. For example, the front portion of the bra (FIG. 3A) has wider shoulder straps 323 and a scoop neck 301, while the back portion of the bra (FIG. 3B) has a higher and more extensive back 302 that is fully integrated with the straps. As shown in FIG. 3B, the back portion also has the arm holes 322 cut more deeply into the back thereby showing more of the user's back. The ultrasheer sleeves 340 are double stitched to the arm holes 322 and are as described above, including elasticized wrist portions 342. An elasticized support band 344 is stitched to the garment below the bra cups.

Figure 4A:
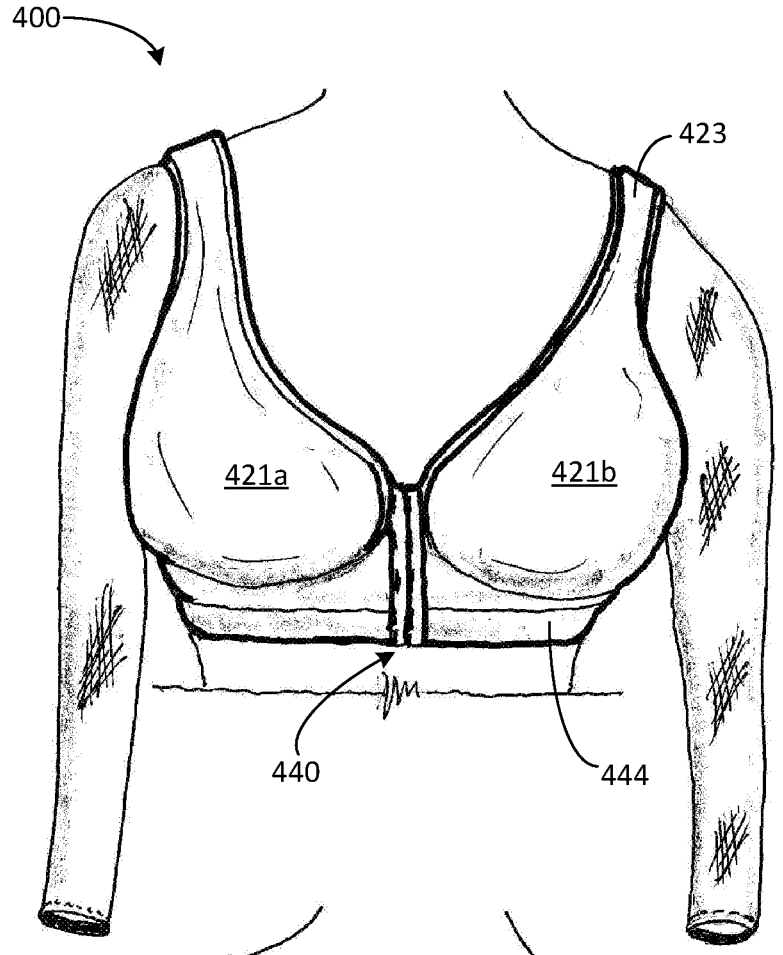
FIG. 4A is a front perspective view of a third embodiment of a bra with front clasp having sheer support sleeves attached to the bra.
Figure 4B:
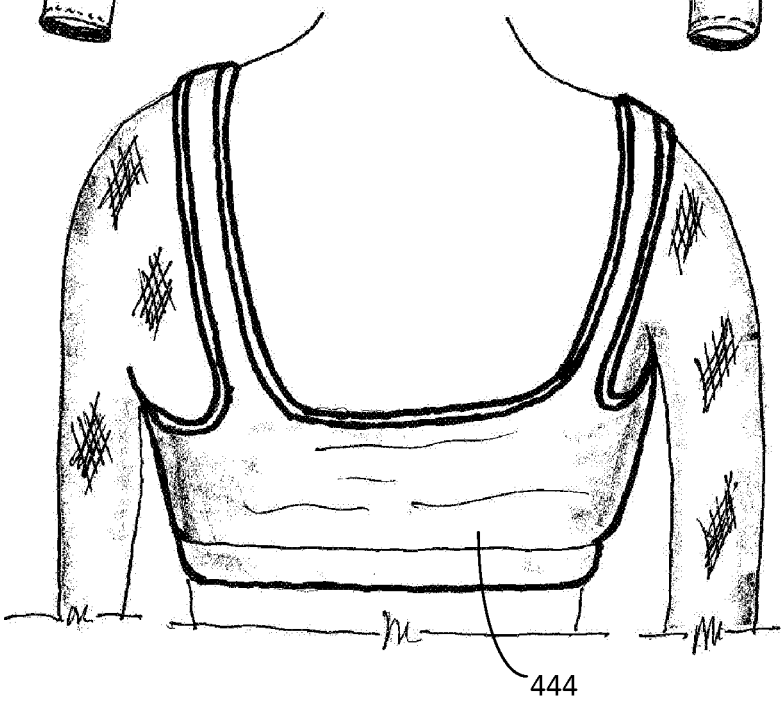
FIG. 4B is a rear perspective view of the bra shown in FIG. 4A.

FIGS. 4A and 4B illustrate another alternative bra 300 having a front clasp in a more traditional bra style. For example, the front portion of the bra (FIG. 4A) has narrow shoulder straps 423, with distinct left and right bra cups 421*a*, 421*b*, and a front clasp 450 configured between the bra cups. The clasp 450 may be of any conventional design and is stitched onto the garment using conventional techniques. As previously described, the ultrasheer sleeves 440 are double stitched to the arm holes 422 and the wrist portions 442 are finished with elasticized bands. An elasticized support band 444 is stitched to the garment below the bra cups.

One method for manufacturing a garment or undergarment as described herein includes providing an existing sleeveless garment or undergarment that has shoulder straps, and then sewing a pair of sheer sleeves having elasticity to the shoulder straps, preferably to the underside of the straps. The sleeves are made as described above and could be offered in different skin tone shades and different arm lengths. In a prototype, Hanes pantyhose were cut and used for the sleeve portions.

It should be apparent from the foregoing that there are a number of ways to implement the principles described herein, and thus, the description is intended to cover various modifications and similar arrangements as would be apparent to those skilled in the art. Therefore, the scope of the appended claims should be accorded the broadest interpretation so as to encompass all such modifications and similar arrangements.

The invention claimed is:

1. A garment, comprising:

a bra having a pair of first openings for arms and a second opening for head and neck; and a pair of long sleeves made from a sheer elastic fabric, each sleeve affixed to a respective one of the pair of first openings, each sleeve providing elastic support and compression to arms when worn.

2. The garment of claim 1, wherein the sheer elastic fabric has a linear density of 15 denier or less.

3. The garment of claim 1, wherein the sheer elastic fabric has a sun protection factor of 15 or more.

4. The garment of claim 1, wherein each sleeve is affixed to the first arm opening by a sewn seam.

5. The garment of claim 1, wherein the article of clothing has a pair of shoulder straps that define the pair of first arm openings, and wherein each sleeve is affixed to a respective shoulder strap.

6. The garment of claim 1, wherein the sleeves are made from a combination of nylon and spandex.

7. The garment of claim 1, wherein the sleeves have a color that matches a skin tone shade.

8. The garment of claim 7, wherein the sleeves have color that matches one of a plurality of different skin tone shades.

9. The garment of claim 1, wherein each sleeve has a hem with an elastic finish at a wrist portion of the sleeve.

10. A garment, comprising:

a bra having a pair of arm openings for a bra wearer's arms; and a pair of long sleeves made from a sheer elastic fabric, each sleeve affixed at a first end thereof to a respective one of the pair of arm openings of the bra, and each sleeve providing compressive support to the bra wearer's arms when worn.

11. The garment of claim 10, wherein the sheer elastic fabric has a linear density of approximately 15 denier or less.

12. The garment of claim 10, wherein the bra includes a pair of shoulder straps that define the pair of arm openings, and wherein each sleeve is affixed to a respective shoulder strap.

13. The garment of claim 10, further comprising an elastic support band on a bottom portion of the bra for securing the bra in place.

14. An undergarment, comprising:

a bra having a pair of arm openings; and a pair of sleeves each formed from a sheer fabric, each sleeve affixed to respective ones of the pair of arm openings of the bra, and each sleeve having an elastic character to provide compressive support for arms.

15. The garment of claim 14, wherein the sleeve fabric has a linear density of approximately 15 denier or less.

16. The garment of claim 14, wherein the sleeve fabric has a sun protection factor of 15 or more.

17. The garment of claim 14, wherein the sleeve fabric is a combination of nylon and spandex.

18. The garment of claim 17, wherein the sleeve fabric is approximately 85% nylon and 15% spandex.

19. The garment of claim 1, wherein the sheer elastic fabric is an ultrasheer fabric having a linear density of approximately 10 denier or less.

20. The garment of claim 1, wherein the sheer elastic fabric has a linear density of approximately 30 denier or less.

* * * * *